United States Patent [19]

Broom

[11] 4,325,554

[45] Apr. 20, 1982

[54] GAME WITH BOARD AND TOKENS

[76] Inventor: James C. Broom, The Hermitage, Burtenshaw Rd., Thames Ditton, Surrey, England

[21] Appl. No.: 238,580

[22] Filed: Feb. 26, 1981

Related U.S. Application Data

[62] Division of Ser. No. 958,412, Nov. 7, 1978, Pat. No. 4,272,081.

[51] Int. Cl.[3] ..... A63F 3/00

[52] U.S. Cl. ..... 273/274; 273/308

[58] Field of Search ..... 273/265, 274, 292, 308, 273/303

[56] References Cited

U.S. PATENT DOCUMENTS

| | | | |
|---|---|---|---|
| 1,262,742 | 4/1918 | Brasher | 434/155 |
| 1,632,941 | 6/1927 | Abell | 273/303 |
| 1,925,924 | 9/1933 | Hummel | 273/274 |
| 3,042,408 | 7/1962 | Johnson | 273/273 |

FOREIGN PATENT DOCUMENTS

| | | | |
|---|---|---|---|
| 478690 | 10/1975 | Australia | 273/265 |
| 991386 | 5/1965 | United Kingdom | 273/274 |

*Primary Examiner*—Anton O. Oechsle

*Attorney, Agent, or Firm*—Dann, Dorfman, Herrell and Skillman

[57] ABSTRACT

A set of 24 cards and a game board. Each card of the set depicts a different girl who is unique with respect to the three different attributes of character, figure and hair color. The character attribute has two alternatives, the figure attribute has three alternatives and the hair color attribute has four alternatives. The girls depicted on the cards are also seperately depicted on the game board. The game board also includes separate areas marked to represent the different alternatives of the above described nine attributes whereby a wagering game may be played.

3 Claims, 5 Drawing Figures

GAME WITH BOARD AND TOKENS

This is a division, of application Ser. No. 948,412 filed Nov. 7, 1978, now U.S. Pat. No. 4,272,081.

This invention relates to an improved game of skill for at least three players in which the players compete against each other to correctly select one item from a set of such items on the basis of a logical appraisal of remaining options on the nature of the said one item. The game may also include a facility for gaming.

In its broadest aspect the invention comprises a plurality of playing tokens defining a set, each token in the set being unique with regard to its selection of one of each of m different attributes, there being $n_1, n_2 \ldots n_m$ different possibilities for each attribute and at least $n_1 \times n_2 \times \ldots \times n_m$ tokens in the set, and a playing area on which the individual tokens in the set are represented and areas are provided on which indication can be given as to which token or which attribute or attributes of the tokens, has or have been selected by the players, $n_1, n_2 \ldots n_m$ being whole integers greater than one and m a whole integer greater than 2.

The complexity of the game is related to the whole numbers chosen for m, $n_1, n_2 \ldots n_m$ and a particularly convenient arrangement is for m and $n_2$ to equal 3, for $n_1$ to equal 2 and for $n_m$ to equal 4. The tokens can be cards bearing representations of the different girls in a sultan's harem, the attributes being the character of the girls, the figure of the girls and the hair colour of the girls. Alternatively the tokens can be cards bearing different multiplication sums, the numerical factors of the multiplication sums being the attributes. However it will be appreciated that the choice of the number and type of attributes, the form of the tokens and the forms of the playing area are open to wide variation.

According to one preferred aspect of the invention game equipment comprises a set of 24 cards and a game board, each card in the set depicting a different girl in a Sultan's harem and, being unique with regard to its selection of one of each of three different attributes of the girls, a first attribute of which there are two alternatives, a second attribute of which there are three alternatives and a third attribute of which there are four alternatives, the game board reproducing the 24 girls depicted on the cards and also including separate areas marked to represent the different alternatives of the nine attributes found in the set of cards.

Suitably the girls are named in eight groups of three, each group of names having the same initial letter which differs from those of all the other groups.

Figure 1A:
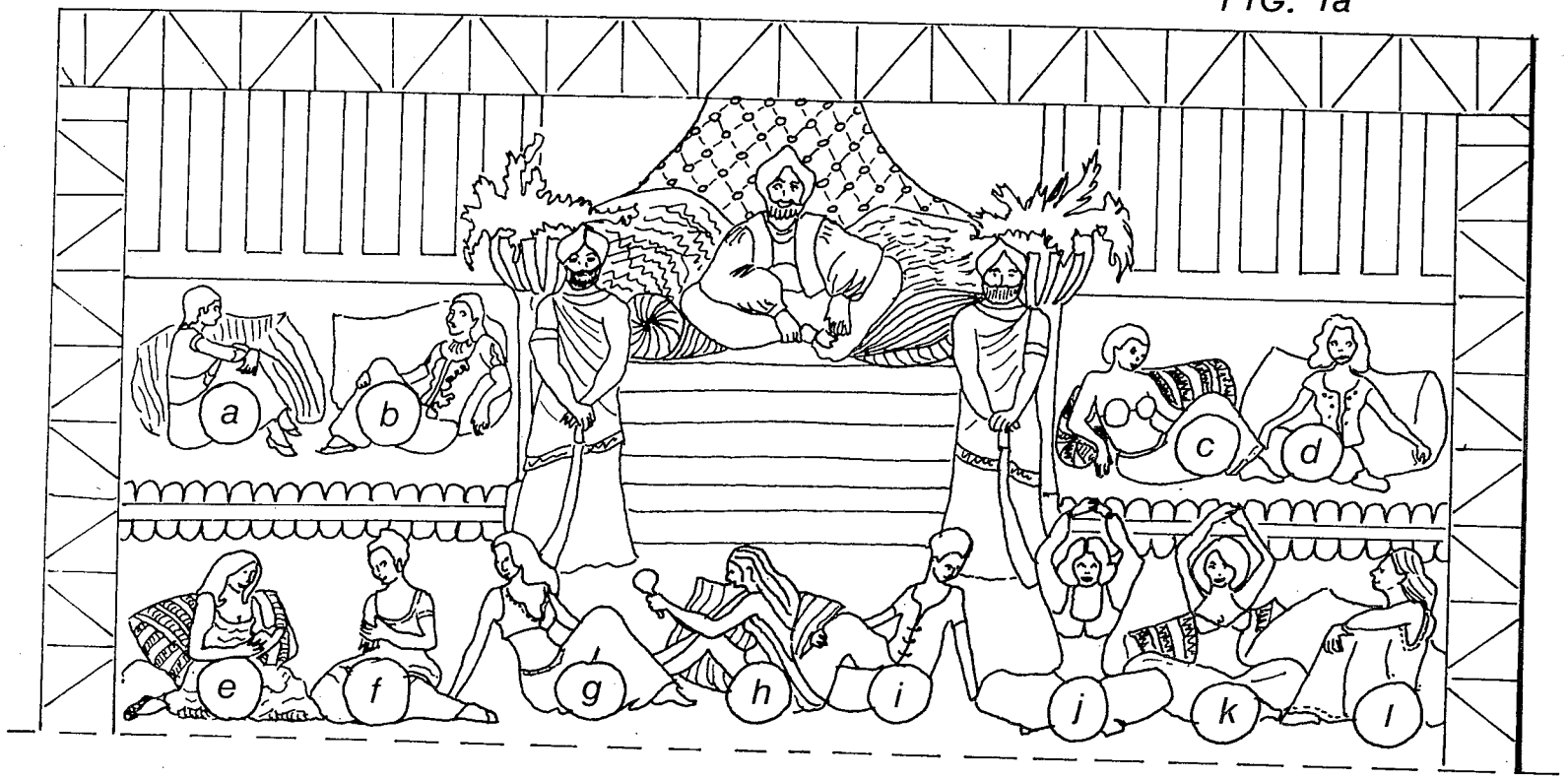
Figure 1B:
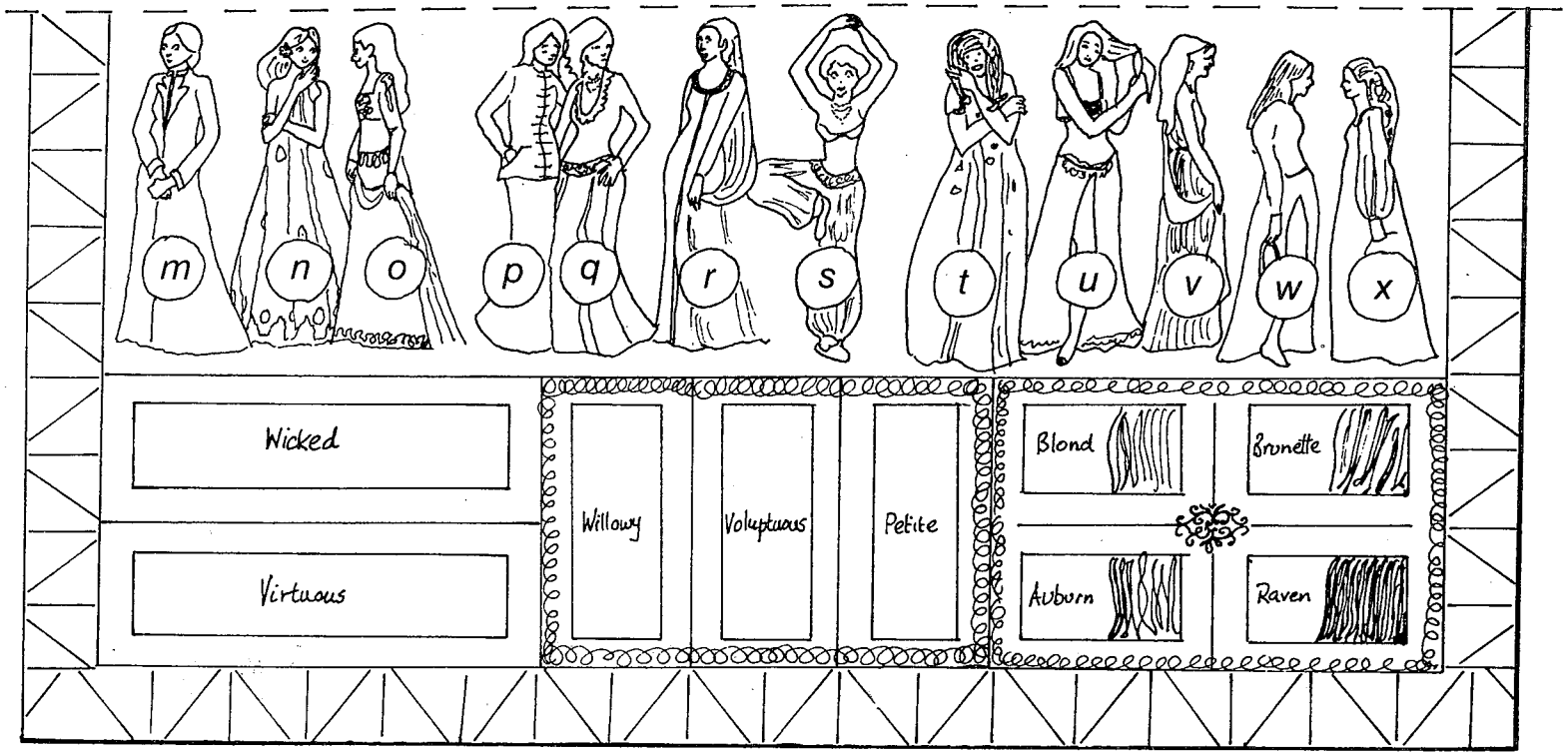
Figure 2A:
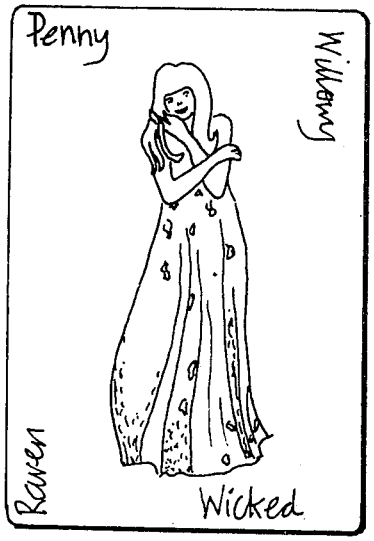
Figure 2B:
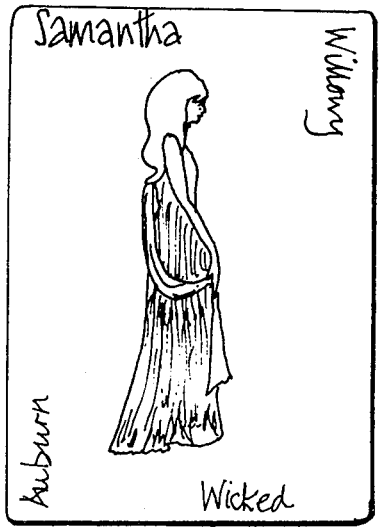
Figure 2C:
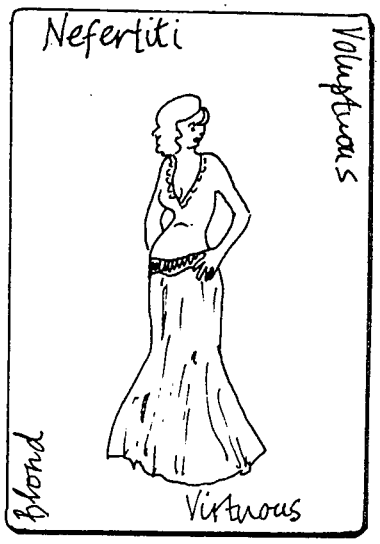

A preferred form of game in accordance with the invention will now be described, by way of example, with reference to the accompanying drawings, in which FIGS. 1*a* and 1*b* are the upper and lower halves, respectively, of a playing area of a game board of a game in accordance with the invention, and FIGS. 2*a*, 2*b* and 2*c* show examples of some of the tokens used with the board of FIGS. 1*a* and 1*b*.

Referring to FIGS. 1*a* and 1*b*, the playing area includes an area for the reception of a pack of rectangular cards (the faces of three of which are shown in FIGS. 2*a*, 2*b* and 2*c*) from which a sought-after card has been removed. The playing area also represents the Sultan, two eunuchs and twenty-four girls forming the Sultan's harem, each representation of a girl being associated with her name, her character (wicked or virtuous), her figure (willowy, voluptuous or petite) and her hair colour (blond, auburn, brunette or raven). The pack of cards includes one card to represent each girl and two cards representing the eunuchs (26 cards in all).

The lettered circles on the playing area contain the following legends, the drawing being on too small a scale to permit the legends themselves to be entered on FIGS. 1*a* and 1*b*.

a—DANIELLE—Raven—Petite—Virtuous
b—DEIRDRE—Brunette—Petite—Wicked
c—DODO—Brunette—Voluptuous—Wicked
d—FANNY—Auburn—Petite—Virtuous
e—FLICK—Raven—Voluptuous—Virtuous
f—FRANCOISE—Brunette—Voluptuous—Virtuous
g—HELENA—Auburn—Voluptuous—Virtuous
h—HONEY—Blond—Petite—Wicked
i—HONOR—Raven—Willowy—Virtuous
j—JAN—Auburn—Voluptuous—Wicked
k—JILLY—Raven—Voluptuous—Wicked
l—JO—Blond—Petite—Virtuous
m—LEONIE—Blond—Willowy—Wicked
n—LISA—Blond—Willowy—Virtuous
o—LULU—Auburn—Willowy—Virtuous
p—NAOMI—Brunette—Willowy—Virtuous
q—NEFERTITI—Blond—Voluptuous—Virtuous
r—NORA—Brunette—Willowy—Wicked
s—PATTY—Auburn—Petite—Wicked
t—PENNY—Raven—Willowy—Wicked
u—PETULA—Blond—Voluptuous—Wicked
v—SAMANTHA—Auburn—Willowy—Wicked
w—SANDRA—Raven—Petite—Wicked
x—SHERRY—Brunette—Petite—Virtuous The lower part of the playing area defines gaming regions on which chips can be placed to indicate the placing of bets in support of a player's prediction of the Sultan's choice in the manner described in the following rules of the game of SULTAN:

Each player is provided with an equal value of gaming chips at the commencement of the game. The game consists of a series of rounds in which one of the players is Sultan, and acts as banker. The Sultan usually changes each round.

One player shuffles the pack and deals. The first player to receive a eunuch is the Sultan for the first round.

The Sultan chooses someone from his harem and removes the chosen card from the pack without letting the other players see the face of the selected card. The rest of the players wager on the "Sultan's Choice" and place chips to the value of their wagers either on the appropriate regions on the lower part of the playing area or, if they wish to wager on a particular girl, on her representation on the playing area. The odds can be as follows:

Character—Evens
Figure—2-1
Hair Colour—3'
Individual Girl—23-1

The rest of the players may place more than one wager.

Once all the wagers are placed, the rest of the players try to identify the "Sultan's Choice". The Sultan shuffles the pack, places it on the playing area and asks one of the other players to cut and reveal the bottom card of the upper part of the pack. If this card is a eunuch, the Sultan wins all the bets on the board. A new round starts with the same player as Sultan.

If the card is not a eunuch the Sultan deals each of the other players one card, face down, having first compared each card with the "Sultan's Choice" and tells the respective player how many common attributes his card has with the "Sultan's Choice". The eunuch has no common attributes. The other players may only pick up their cards when all the other players have been dealt their first card and must not show the faces of their cards to anyone else.

The Sultan then proceeds to lay cards one by one face up where all the other players can seem them, indicating verbally, or in some other way, how many attributes the displayed card has in common with the "Sultan's Choice".

Throughout these questions the other players are attempting to identify the "Sultan's Choice" using personal information given to them with the distribution of cards, the verbal information given to others during that distribution and the commonly available information from the subsequently displayed cards.

The first of the other players who believes he can identify the attributes of the "Sultan's Choice" shouts "call". He must immediately specify the character, figure and hair colour (in any order) or give the girl's name. If he is correct, he becomes Sultan for the next round, the current round finishing with the Sultan collecting the incorrect wagers from the board and paying out on the correct wagers.

If the "call" is incorrect the player making it forfeits a certain value of chips to the Sultan and the laying down of cards continues until a second one of the other players is ready to shout "call" and be given the chance to identify the attributes (or name) of the "Sultan's Choice". (The first player to "call" may not "call" a second time). If the second "call" is correct the player making it becomes Sultan in the next round and the current round is concluded with the Sultan collecting the incorrect wagers and paying out on the correct wagers.

If the second caller is incorrect, the caller forfeits a value of chips greater than said certain value and the Sultan reveals the "Sultan's Choice" to the players, collects the incorrect wagers, pays out on the correct wagers and remains Sultan for the next round.

If no player makes any "call" (either a first "call" or a second "call" following an incorrect first "call") when 3 cards have been exposed sequentially by the Sultan, the player acting as the Sultan remains so for the next round. Wagers on the current round are dealt with as usual.

The other players will not be able to identify the "Sultan's Choice" from the personal information they receive, although they should be able to narrow the alternatives to 2 or 3 girls after the second face-up card has been displayed. They may "call" and guess the correct attributes (or name) at any time they wish.

If 2 or more of the other players "call" at the same time, the Sultan asks each in turn to identify the attributes (or name) of the "Sultan's Choice", waiting for all who took part in the simultaneous "call" to make their identification before saying who are correct and who are incorrect. Any player making an incorrect simultaneous "call" forfeits chips to a value corresponding to that previously required depending on whether or not the simultaneous "calls" were the first or second to have been made in that round. If more than one player's simultaneous call is correct, the Sultan shuffles the pack and deals one card at a time to the players making the correct simultaneous "calls". The first player to receive a eunuch becomes the next Sultan.

A player running out of chips may borrow from any other player in return for a written I.O.U.

The winner of the game is the player with the highest value of chips after a pre-set number of rounds or a predetermined amount of time.

Players may make the odds less favourable to the Sultan by discarding one eunuch card from the pack.

In a modified version of SULTAN, following the distribution of the first set of cards to the other players, second and third sets are distributed in precisely the same manner, there then being no face-up display of cards for all the other players to see together.

As another alternative, two sets of face-down cards can be distributed followed by one, two or three common face-up displays.

Making more of the code-breaking information personal to each player in the way employed in these modified versions of SULTAN, off-sets, to some extent, the advantage which a particularly astute or experienced player can have over his less astute or experienced competitors.

The equipment illustrated in FIGS. 1 and 2 can be used in a variety of different ways and among these may be mentioned the following game:

SULTAN'S CHOICE

This differs from the previous game only in that instead of making personal distribitions of cards to each player, the Sultan lays cards from the pack one by one face up where all players can see them and indicates (verbally or by the manner in which the card is displayed or by placing an appropriate marker on the girl's image on the board) how many attributes that card has in common with the "Sultan's Choice".

It will be noted that the names of the girls, although all different, have only eight different initial letters, there being three girls with each initial letter. A further gaming possibility exists of wagering on the initial letters for which odds (of say) 6 to 1 can be offered.

VARIATIONS

1. The game can be played without the board. After calling the number of common factors for the cards forming the general clues, the cards can be placed face upwards on the table and the markers then placed directly on the cards.

2. The game can be played using either all personal clues or all general clues or any combination of any number and type of clue agreed by the players.

3. The game can be played by just two players in which case the distinction between the two types of clue is no longer relevant.

4. An alternative form of marking can be employed using counters. These can be placed in a pool, and players draw a counter for each point scored. The player with the highest number of counters at the end of the game is the winner. This approach also enables the game to be used for gambling purposes. Each player can contribute an agreed sum of money to a pool, which can be topped up as required, with players always contributing equal amounts to the pool.

It will be appreciated that the versions of games described in detail are but examples of the invention and wide varieties of different possibilities are open for the choice of the type of tokens and the different attributes selected for playing the game.

What is claimed is:

1. Game equipment comprising a set of 24 cards and a game board, each card in the set depicting a different girl in a Sultan's harem and, being unique with regard to its selection of one of each of three different attributes of the girls, a first attribute of which there are two alternatives, a second attribute of which there are three alternatives and a third attribute of which there are four alternatives, the game board reproducing the 24 girls depicted on the cards and also including separate areas marked to represent the different alternatives of the nine attributes found in the set of cards.

2. Game equipment as claimed in claim 1 in which the attributes are character, figure, and hair color of the girls.

3. Game equipment as claimed in claim 1, in which each card bears the name of the girl depicted thereon and the girls are named in eight groups of three, each group of names having the same initial letter which differs from those of all of the other groups.

* * * * *

UNITED STATES PATENT AND TRADEMARK OFFICE

CERTIFICATE OF CORRECTION

PATENT NO. : 4,325,554

DATED : April 20, 1982

INVENTOR(S) : James C. Broom

It is certified that error appears in the above-identified patent and that said Letters Patent are hereby corrected as shown below:

Column 2, line 56, "3'" should read --3-1--.

Column 3, line 8, "seem" should read --see--.

Signed and Sealed this

Sixth Day of July 1982

[SEAL]

Attest:

GERALD J. MOSSINGHOFF

Attesting Officer

Commissioner of Patents and Trademarks